United States Patent [19]

Gurries et al.

[11] 4,374,602

[45] Feb. 22, 1983

[54] PAVEMENT CUTTER

[76] Inventors: Raymond A. Gurries, 1420 Eli Dr., Reno, Nev. 89511; Harry J. Stormon, 908 Camino Real Dr., Sparks, Nev. 89431

[21] Appl. No.: 237,202

[22] Filed: Feb. 23, 1981

[51] Int. Cl.[3] ..... E01C 23/12

[52] U.S. Cl. ..... 299/37; 299/14

[58] Field of Search ..... 299/36, 37, 14; 404/90, 404/133; 241/270, 271, 283, 285 R

[56] References Cited

U.S. PATENT DOCUMENTS

| | | | |
|---|---|---|---|
| 968,422 | 8/1910 | Rosenholz | 299/37 |
| 2,539,136 | 1/1951 | Hite | 299/36 X |
| 2,768,794 | 10/1956 | Putnam | 299/36 X |
| 3,232,669 | 2/1966 | Bodine | 299/37 |
| 3,367,716 | 2/1968 | Bodine | 299/14 |
| 3,437,381 | 4/1969 | Bodine | 299/37 |
| 3,475,841 | 11/1969 | Delfino et al. | 299/37 X |
| 3,527,501 | 9/1970 | Shatto | 299/37 |
| 3,633,683 | 1/1972 | Shatto | 299/14 X |
| 3,698,484 | 10/1972 | Kinnan | 172/40 |
| 3,980,341 | 9/1976 | Musannif et al. | 299/36 |
| 4,230,369 | 10/1980 | Gurries | 299/37 X |
| 4,309,126 | 1/1982 | Pfaff | 299/37 X |

*Primary Examiner*—Ernest R. Purser

*Attorney, Agent, or Firm*—Townsend and Townsend

[57] ABSTRACT

An improved system for cutting pavement into chunks for excavation is disclosed. A plurality of transversely spaced blade elements are provided with forwardly directed cutting edges, the cutting edges on adjacent blades having alternating downward and upward inclinations. The blade elements are attached to a frame so that the elements are reciprocable forwardly and rearwardly. The frame is motivated so that the cutting edges of the blade elements intersect the edge of the pavement. A resonant drive supported by the frame has a vibratory output coupled to the blade elements to drive the blade elements intermittently forwardly and against the pavement. Adjacent cutting elements force the pavement upwardly and downwardly respectively to break the pavement into chunks.

19 Claims, 4 Drawing Figures

PAVEMENT CUTTER

BACKGROUND OF THE INVENTION

The present invention relates to a system for cutting pavement such as concrete and other road surfaces into chunks so that the pavement can be easily excavated.

As road systems mature complete removal of old pavement is often required, and before the pavement can be removed it must be broken up into relatively small chunks. Tractors have relatively little traction on pavement, and conventional ripping tools mounted to such tractors are ineffective in removing most types of pavement. In addition, ripping tools generally break the pavement into chunks too large to be readily excavated. As a result, old pavement is usually broken into chunks using a chiseling device which is repeatedly driven downwardly into the pavement. Unfortunately, breaking apart large expanses of pavement in this fashion is very slow, and resultingly expensive, because use of the single chiseling tool to break up a two dimensional surface requires operation of the tool in a grid pattern.

SUMMARY OF THE INVENTION

The present invention provides an improved system for cutting pavement into chunks for excavation. A plurality of transversely spaced blade elements are provided with forwardly directed cutting edges, the cutting edges on adjacent blades having alternating downward and upward inclinations. The blade elements are attached to a frame so that the elements are reciprocable forwardly and rearwardly. The frame is motivated so that the cutting edges of the blade elements intersect the edge of the pavement. A resonant drive supported by the frame has a vibratory output coupled to the blade elements to drive the blade elements intermittently forwardly and against the pavement. Adjacent cutting elements force the pavement upwardly and downwardly respectively to break the pavement into chunks.

The system of the present invention provides a motivating force for the blade elements which does not rely on the traction of the vehicle for its driving force. The driving force is provided by the resonant drive so that the blade elements are effectively driven against the edge of the concrete even if the tractor has little traction. The alternating inclinations of the blades impart a tension stress to the pavement, and while pavement is strong in compression it is weak in tension and is readily broken into chunks by the system of the present invention. Notches may be provided on the blades to cut reinforcing wires in the pavement which, unlike the pavement itself, are strong when subjected to tension.

The system of the present invention preferably incorporates a plurality of resonant angulate beams having inwardly directed mounting flanges attached to the frame. The angulate beams have integral oscillators at one end which are synchronously driven to vibrate the other ends of the beams in a near resonant fashion. The output ends of the angulate beams strike the support for the blades to drive them intermittently forwardly against the edges of the pavement. This system provides a very compact unit which is highly efficient in breaking up broad expanses of pavement in an expeditious manner.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
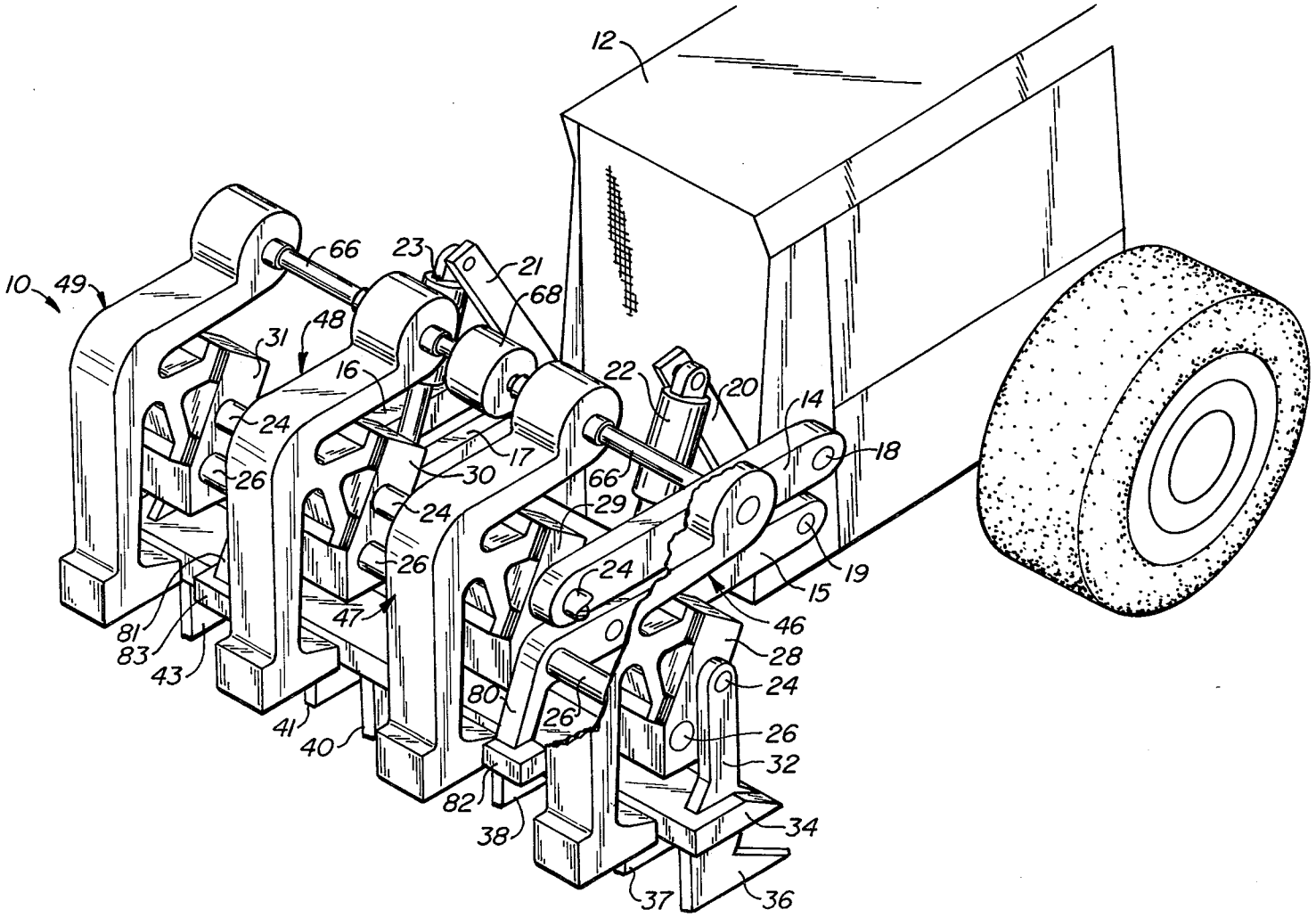
FIG. 1 is a perspective view of a preferred embodiment of the present invention.
Figure 2:
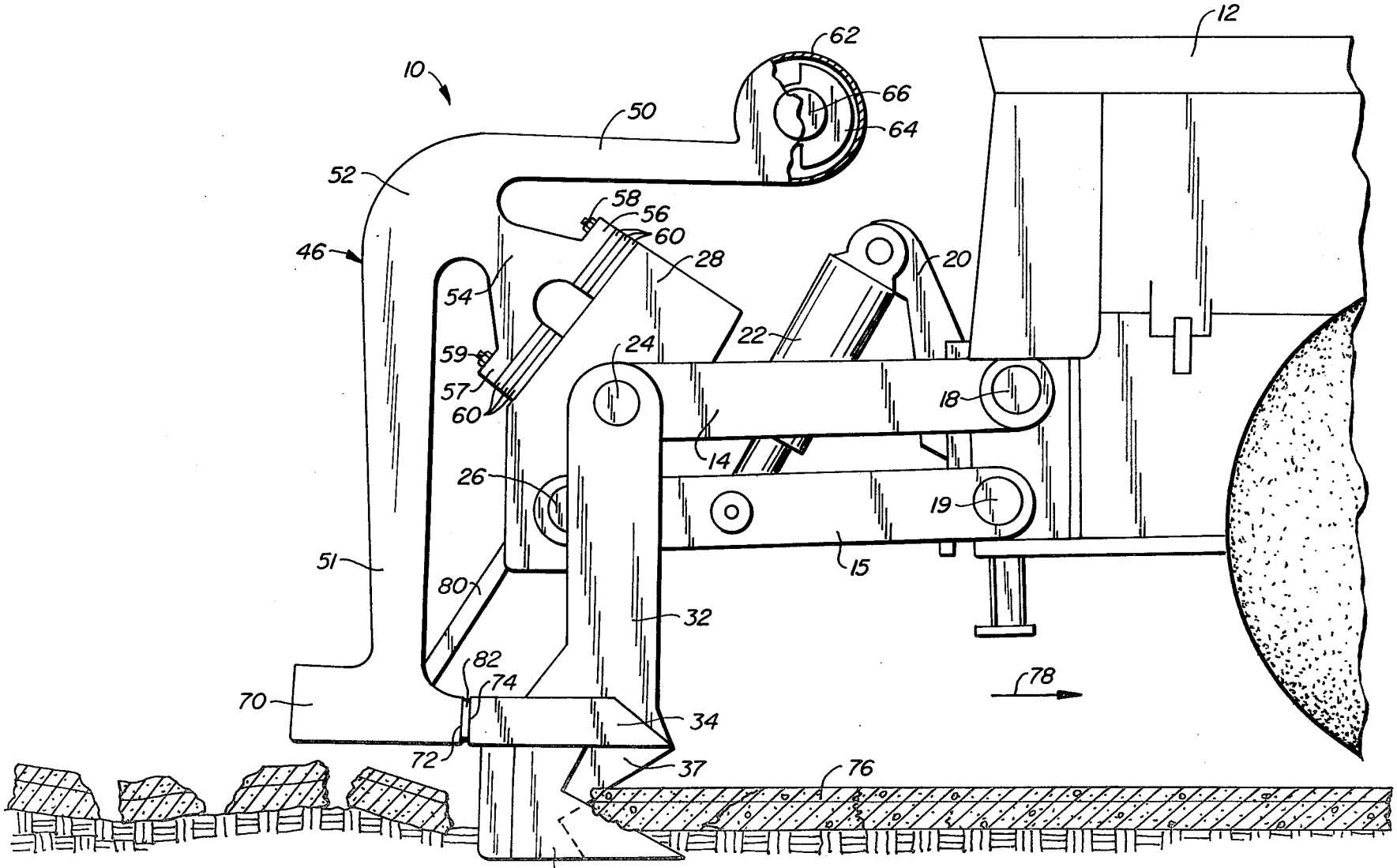
FIG. 2 is a side elevation view of the embodiment of FIG. 1.

The preferred embodiment 10 of the pavement cutter of the present invention is generally illustrated by way of reference to FIGS. 1 and 2. Pavement cutter 10 is attached to the back of a mobile vehicle 12 which is only partially illustrated in the Figures.

A set of four members 14–17 project rearwardly from the rear of vehicle 12. Members 14–17 are pivotably connected to the vehicle as illustrated by pin connections 18, 19 on members 14, 15 respectively. A pair of members 20, 21 are fixed to vehicle 12, and hydraulic actuators 22, 23 are suspended from members 20, 21 respectively and attached to lower members 15, 17.

A transverse shaft 24 passes through apertures at the free ends of members 14 and 16. A second transverse shaft 26 passes through corresponding apertures at the free ends of lower members 15, 17. The combination of members 14–17 and rods 24 and 26 provide a parallelogram structure which can be moved vertically by actuators 22, 23 without distorting the relative orientations of shafts 24 and 26.

Four frame elements 28–31 are mounted to shafts 24, 26 and spaced along the length of the shafts. Shafts 24, 26 pass through apertures in frame elements 28–31 and are rotatable with respect to the frame elements so that the frame elements translate vertically in response to actuation of hydraulic cylinders 22, 23 without changing their angular orientation.

A pair of hanger arms 32 depend from the respective ends of shaft 24, which is rotatable so that the hanger arms are free to swing forwardly and rearwardly. A blade support 34 is attached to the bottom of hanger arms 32 and is movable therewith. A plurality of blade elements 36–44 are fixed to the under side of blade support 34 so that the blade elements swing from shaft 24 and are reciprocable forwardly and rearwardly in unison.

A plurality of angulate beams 46–49 are transversely spaced relative to one another. Angulate beams 46–49 are substantially identical, and referring to beam 46 by way of example, each beam includes a pair of legs 50, 51 terminating at a juncture 52 at an included angle of about 90°. A mounting flange 54 projects inwardly from juncture 52, and terminates in a pair of laterally spaced mounting ears 56, 57. Mounting ears 56, 57 are attached to frame element 28 by bolts 58, 59, and a plurality of removable shims 60 are interposed between the respective mounting ears 57, 58 and frame elements 28. Shims 60 can be added and removed as required to adjust the angle of inclination of the angulate beam.

Each angulate beam such as 46 has an integral oscillator housing 62 containing one or more eccentric weights 64 on a drive shaft 66. A hydraulic motor 68 (see FIG. 1) powers drive shaft 66 to rotate the weights 64 in the respective oscillator housings in sequence to impart a vibratory motion to leg 50 of the angulate beams. Such input variations are near the resonant frequency of the beam, causing the entire beam to vibrate in near resonance.

Leg 51 of each angulate beam such as beam 46 includes an enlarged hammer portion 70 at its free end. Hammer portion 70 terminates at a striking face 72 which is in close proximity to the rear surface 74 of blade support 34.

When vehicle 12 moves forwardly, as illustrated by arrow 78 in FIG. 2, blade elements 36–44 intersect the edge of pavement 76 and the blade elements and blade support 34 are moved rearwardly relative to the vehicle (they are stationary relative to the pavement). Hydraulic motor 68 causes angulate beams 46–49 to vibrate in unison, and their lower output ends strike the rear surface 74 of blade support 34, driving the blade support and its attached blade elements 36–44 in a forward direction against the edge of pavement 76, as illustrated in FIG. 2. After being struck by beams 46–49, blade support 34 moves rearwardly again relative to the vehicle until the next strike by the resonant beams 46–49. Accordingly, blade elements 36–44 move in a reciprocal forward and rearward fashion relative to the vehicle, being driven forwardly by the angulate beams and returned rearwardly by pavement 76 between strikes of the beams.

A pair of members 80, 81 project downwardly from frame elements 29, 31 so that the members are fixed relative to the frame elements. Stops 82, 83 are located at the free end of members 80, 81 respectively, immediately behind the rear surface 74 of blade support 34. Stops 82, 83 limit rearward travel of blade support 34 so that the rear striking surface 74 thereof is always maintained at least slightly forward of the neutral (i.e., rest) position of the forward surface 74 of the angulate beams. In this fashion, blade support 34 is prevented from moving rearwardly sufficiently to cause the angulate beams 46–49 to lose resonance.

Figure 3:
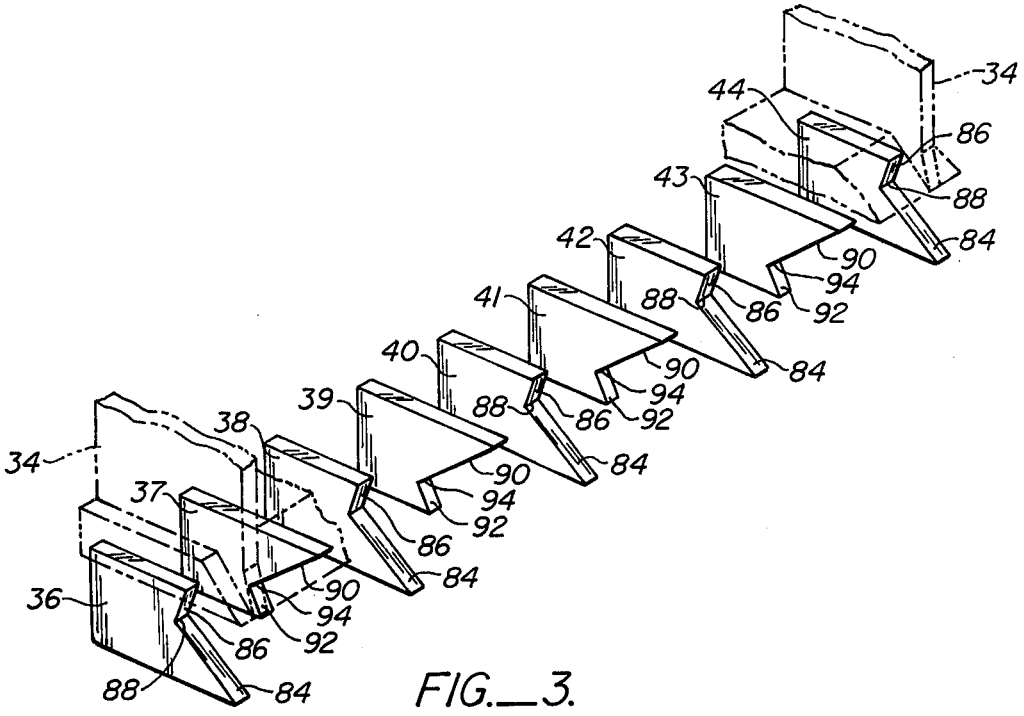
FIG. 3 is a perspective view of the cutting blade portion of the preferred embodiment with related portions shown in phantom.
Figure 4:
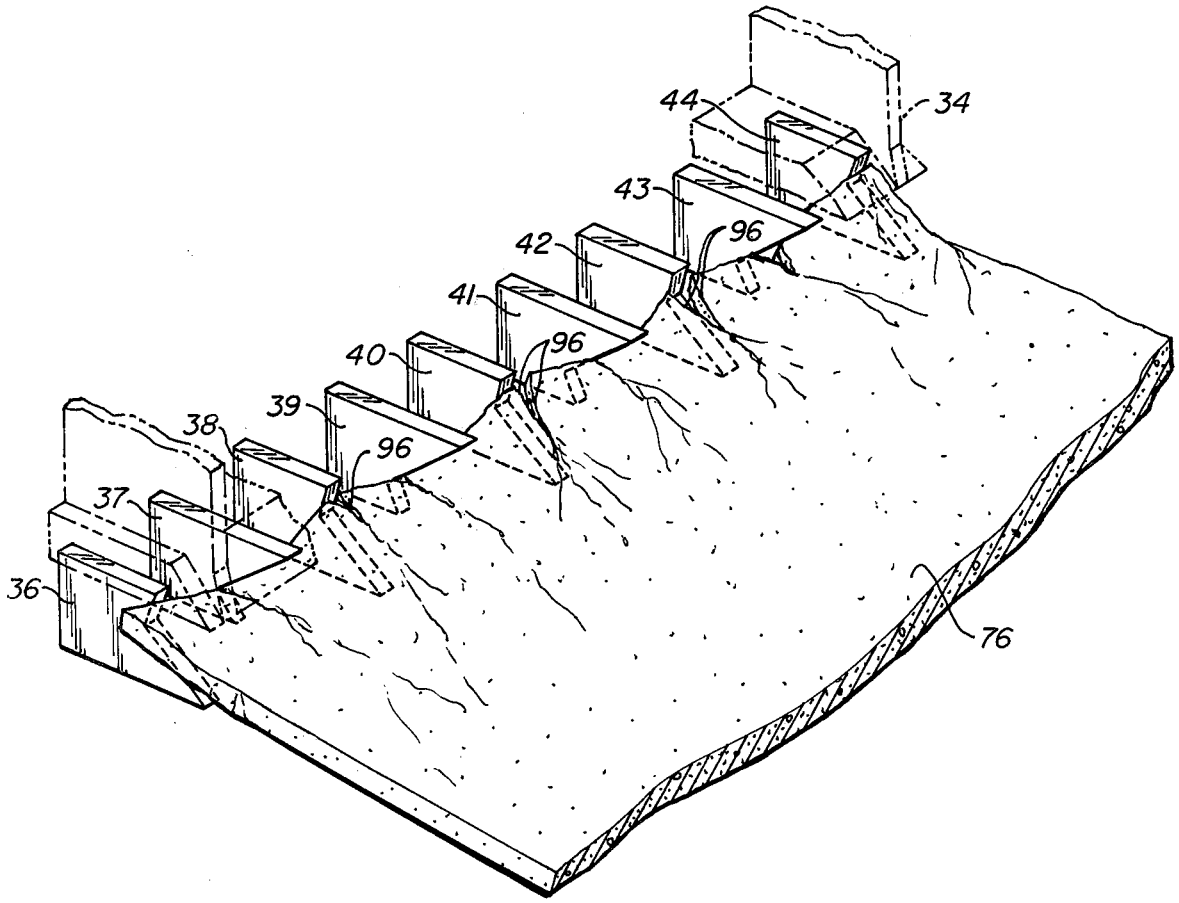
FIG. 4 is a view similar to that of FIG. 3 illustrating the operation of the device in cutting a section of pavement.

The operation of blade elements 36–44 is illustrated in more detail by way of reference to FIGS. 3 and 4. Alternating blade elements 36, 38, 40, 42 and 44 have an upwardly inclined cutting surface 84, terminating in a short downwardly connecting surface 86 to form a notch 88. As blade elements 36, 38, 40, 42 and 44 are driven against pavement 76 (see FIG. 4) they force the pavement to move upwardly.

Alternating blade elements 37, 39, 41 and 43 each have a downwardly inclined cutting edge 90, which terminates in a short upwardly inclined segment 92 to form a notch 94. When cutting elements 37, 39, 41 and 43 are driven against pavement 76 (FIG. 4), they force the pavement downwardly.

The combination of the upward thrust provided by blade elements 36, 38, 40, 42 and 44 with the downward thrust provided by blade elements 37, 39, 41 and 43 stretches pavement 76 to apply tension loads on the pavement. Pavement such as concrete is quite weak in tension, and thus the tension loads imposed readily break up the concrete into relatively small chunks.

Certain types of pavement, primarily concrete, have reinforcing wires 96 embedded in the pavement to increase its structural rigidity. The notches 88 and 94 in the cutting elements have sharp edges so that the reinforcing wires 96 are cut as the pavement passes between the blade elements.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A system for cutting pavement into chunks to facilitate excavation thereof comprising:

a first plurality of trasversely spaced blade elements having cutting edges which project forwardly and upwardly,;

a second plurality of transversely spaced blade elements having cutting edges which project forwardly and downwardly, blade elements of said first plurality being generally alternated with blade elements of said second plurality;

a frame for mounting the blade elements;

means for attaching the blade elements to the frame so that the blade elements are reciprocable forwardly and rearwardly;

means for motivating the frame so that the cutting edges of the blade elements intersect the edge of the pavement; and a resonant drive supported by the frame and having a vibratory output, said resonant drive including means for operatively coupling said output to the blade elements to drive said blade elements intermittently forwardly and against the pavement, adjacent cutting edges forcing the pavement upwardly and downwardly respectively to break the pavement into chunks.

2. The system of claim 1 wherein the resonant drive comprises a plurality of transversely spaced synchronous resonant members each having a vibratory output operatively coupled to the blade elements.

3. The system of claim 1 wherein the attaching means includes a blade support reciprocable forwardly and rearwardly, and wherein the blades are fixed to the blade support.

4. The system of claim 1 wherein the resonant system includes a stop limiting rearward movement of the blade elements to a position forward of the neutral position of the vibratory output.

5. The system of claim 1 wherein the resonant drive includes an angulate beam having a pair of legs meeting at a central juncture at an included angle of approximately 90°, one end of said beam including a vibratory input and the other end of said beam providing the vibratory output.

6. The system of claim 1 wherein the attaching means comprises means for suspending the blade elements from the frame.

7. The system of claim 1 wherein the motivating means includes a vehicle, and means for mounting the frame to the vehicle.

8. The system of claim 1 wherein the cutting edges of the blade elements include forwardly opening notches having a sharp edge for cutting reinforcing wires in the pavement.

9. A system for cutting pavement into chunks to facilitate excavation thereof comprising:

a vehicle including a mounting frame movable with the vehicle;

a blade support suspended from the frame so that said support is reciprocable forwardly and rearwardly relative to the frame, said support having a rear transversely extending striking surface;

a plurality of transversely spaced blade elements attached to the support and having forwardly directed cutting edges, said cutting edges on adjacent blades having alternating downward and upward inclinations terminating in the aft direction in a forwardly opening notch, said cutting edges intersecting the edges of the pavement as the vehicle is motivated, and a plurality of resonant beams having synchronous vibratory outputs within striking distance of the striking surface of the blade support to drive the cutting edges of the blade elements intermittently forwardly against the edge of the pavement, adjacent cutting edges forcing the pavement upwardly and downwardly respectively while the notches cut reinforcing wires in the pavement to break the pavement into chunks.

10. The system of claim 9 wherein the resonant drive includes an angulate beam having a pair of legs meeting at a central juncture at an included angle of approximately 90°, one end of said beam including a vibratory input and the other end of said beam providing the vibratory output.

11. The system of claim 13 wherein the angulate beam includes a support member projecting inwardly from the juncture of the legs of the beam, and means for attaching said support member to the frame.

12. The system of claim 9 wherein the attaching means comprises means for suspending the blade elements from the frame.

13. The system of claim 12 wherein the motivating means incluces a vehicle, and means for mounting the frame to the vehicle.

14. A system for cutting pavement into chunks to facilitate excavation thereof comprising:

a mobile frame;

a blade support having a transversely extending rear striking surface mounted to said frame so that the blade support is reciprocal forwardly and rearwardly relative to the frame;

a plurality of transversely spaced blade elements mounted to the blade support and having forwardly directed cutting edges, said cutting edges on adjacent blades having alternating downward and upward inclinations;

means for motivating the frame so that the cutting edges of the blade elements intersect the edge of the pavement;

a plurality of transversely spaced angulate resonant beams mounted to the frame, each said beam having a pair of legs meeting at a juncture at an included angle of about 90° and a mounting flange extending inwardly between the legs for attachment to the frame, one end of each said beam providing a vibratory output within striking distance of the striking surface of the blade support; and means for applying a synchronous vibratory input to the other ends of the beams at near their resonant frequency so that the output ends of the beams drive the blade support and the attached blade elements intermittently forwardly against the pavement, adjacent cutting edges forcing the pavement upwardly and downwardly respectively to break the pavement into chunks.

15. The system of claim 14 wherein the cutting edges of the blade elements include forwardly opening notches having a sharp edge for cutting reinforcing wires in the pavement.

16. The system of claims 9 or 14 and additionally comprising a stop limiting forward movement of the striking surface of the blade support to a position forward of the neutral position of the vibratory outputs of the beams.

17. The system of claim 9 or 14 wherein the resonant beams have enlarged hammer portions at their vibratory outputs to increase the force exerted by said outputs on the blade support.

18. The system of claim 14 wherein said other ends of each of the beams include an integral oscillator housing, and wherein the applying means comprises eccentric oscillators mounted in each respective oscillator housing, and means for synchronously driving the eccentric oscillators at near the resonant frequency of the beams.

19. The system of claim 14 wherein the mounting flange of each beam has mounting ears spaced from one another toward the respective legs of the beam, and additionally comprising shims insertable between the respective ears and the frame for adjustment of the angular position of each beam.

* * * * *